United States Patent [19]

Tatum et al.

[11] 4,401,540

[45] Aug. 30, 1983

[54] APPARATUS FOR REDUCING END EFFECT IN ANODES

[75] Inventors: Joe F. Tatum; Thomas H. Lewis, both of Hattiesburg, Miss.

[73] Assignee: C.E. Equipment Co., Inc., Hattiesburg, Miss.

[21] Appl. No.: 201,949

[22] Filed: Oct. 29, 1980

[51] Int. Cl.[3] ..... C23F 13/00

[52] U.S. Cl. ..... 204/196; 204/147; 204/290 R; 204/290 F

[58] Field of Search ..... 204/147, 148, 196, 197, 204/290 R, 290 F

[56] References Cited

U.S. PATENT DOCUMENTS

| | | | |
|---|---|---|---|
| 915,846 | 3/1909 | Friedheim | 204/290 R |
| 1,477,099 | 12/1923 | Baum . | |
| 1,664,800 | 4/1928 | Mills | 204/197 |
| 2,221,997 | 11/1940 | Polin | 204/196 |
| 2,803,602 | 8/1957 | De Cowsky et al. | 204/196 |
| 2,809,699 | 10/1957 | Battle | 204/196 |
| 2,855,358 | 10/1958 | Douglas . | |
| 2,998,359 | 8/1961 | Anderson . | |
| 3,012,958 | 12/1961 | Vixler . | |
| 3,354,063 | 11/1967 | Shutt . | |
| 3,458,643 | 7/1969 | Dorr | 204/196 |
| 3,486,996 | 12/1969 | Annand . | |
| 3,491,012 | 1/1970 | Winslow, Jr. . | |
| 3,616,354 | 10/1971 | Russell . | |
| 3,616,418 | 10/1971 | Anderson et al. . | |
| 3,725,669 | 4/1973 | Tatum . | |
| 3,729,388 | 4/1973 | De Angelo et al. | 204/290 F |
| 3,929,607 | 12/1975 | Krause . | |
| 4,096,051 | 6/1978 | Annis, Jr. et al. . | |
| 4,175,021 | 11/1979 | Tatum et al. . | |

FOREIGN PATENT DOCUMENTS 866577 4/1961 United Kingdom .

OTHER PUBLICATIONS

Platinum Metals Review, Apr. 1958, pp. 45–47.
Platinum Metals Review, Jan. 1960, pp. 15–17.
Corrosion Technology, Feb. 1960, pp. 50 & 51.
Corrosion Technology, Mar. 1960, p. 81.
Corrosion Technology, Jan. 1962, pp. 14–16.
Corrosion Technology, Feb. 1962, pp. 38–40, 44.
Corrosion Prevention and Control, Oct. 1962, pp. 51, 52 and 54.
"End Effect Phenomena", Corrosion/78, Paper No. 163.
"The Use of Platinum Anodes on Land Based Installation", undated.

*Primary Examiner*—T. Tung
*Attorney, Agent, or Firm*—Dowell & Dowell

[57] ABSTRACT

An apparatus for reducing end effect in anodes used in cathodic protection systems for underground metallic structures and in which the anodes are surrounded by and are in intimate engagement with a carbonaceous material so that an impressed current which is supplied to the anode is discharged from the anode in a substantially uniform current discharge density which is maintained at a level that is electronically conducted by the carbonaceous backfill to the earth. The anode includes an elongated body of electrically conducting material having a plurality of non-conducting segments which separate the body into conducting areas of non-uniform size and which take advantage of mutual interference between adjacent conducting areas to substantially prevent electrolytic current discharge from the anode.

18 Claims, 4 Drawing Figures

Fig. 1
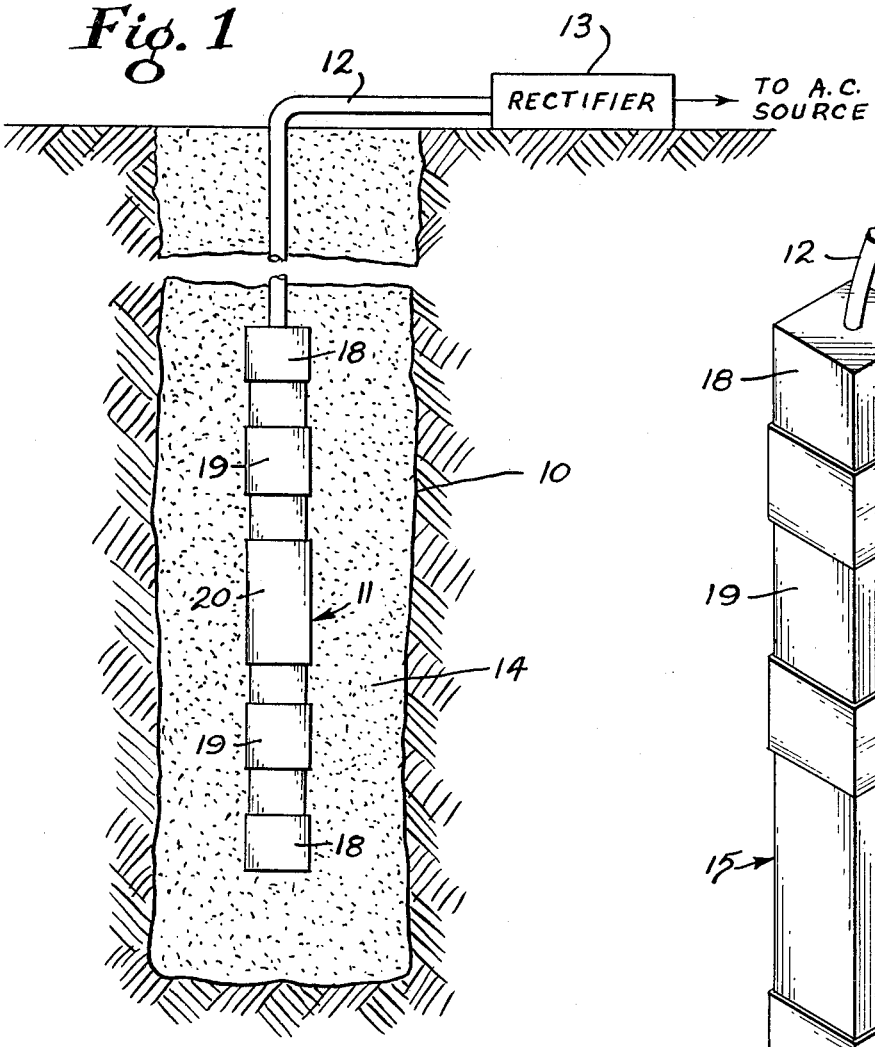
Fig. 2
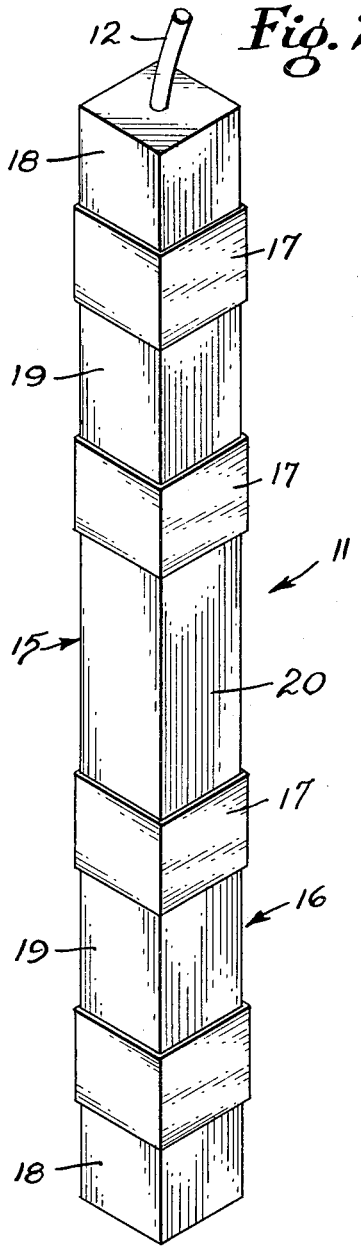
Fig. 3
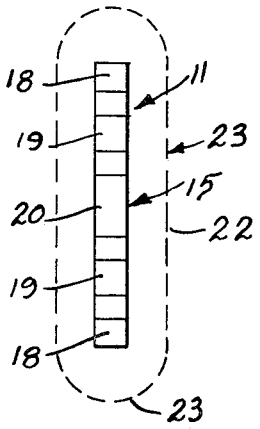
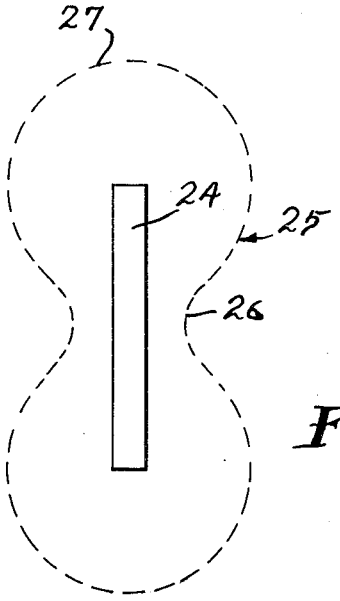
Fig. 4

APPARATUS FOR REDUCING END EFFECT IN ANODES

BACKGROUND OF THE INVENTION

1. Field of the Invention

This invention relates generally to impressed current anodes used in cathodic protection systems for underground metallic structures and relates particularly to anodes having structure which substantially reduces or prevents deterioration of the anodes caused by end effect.

2. Description of the Prior Art

In the past, it has been known that an underground metallic structure has been subjected to chemical or electro-chemical attack which causes rust and other corrosion since the metallic structures normally include both anodic and cathodic areas and that the rust or corrosion occurs in the anodic areas while the cathodic areas remain substantially free of corrosion. It has been recognized that the reason for this is that a galvanic current flows from the ground to the cathodic areas and that the anodic areas discharge an electric current into the ground. It is known that a higher electric current from an impressed current anode system which is located in the general area of the underground metallic structure flows to such structure and overcomes the current discharge of the anodic areas to cause the entire underground metallic structure to become cathodic so that corrosion does not occur.

Heretofore many efforts have been made to provide anodes and anode systems for the cathodic protection of metallic structures and these have included deep anode systems, shallow anode systems, and systems for use in sea water. Initially sacrificial anodes were provided which emitted a galvanic current and these sacrificial anodes slowly disintegrated so that the useful life of the anode was limited. Some efforts were made to extend the life of the sacrificial anodes by covering portions of the anode surface with a dielectric material. However, care was required to permit sufficient current to flow to prevent corrosion of the structure. Some examples of this type of structure are shown in the U.S. Patents to Douglas U.S. Pat. No. 2,855,358; Vixler U.S. Pat. No. 3,012,958; and Shutt U.S. Pat. No. 3,354,063.

In order to extend the effective life of a cathodic protection system and to insure that sufficient current was present at the metallic structure, anodes were provided which were electrically connected to an AC source of electrical energy by a rectifier or the like so that an impressed DC electrical current which would be controlled to certain values was applied to the anodes. The anodes were made of iron, high silicon cast iron, steel, copper, graphite, magnetite, and other materials. Normally, in groundbeds, the anodes were embedded in a carbonaceous backfill material such as calcined petroleum coke, metallurgical coke, graphite and the like. An impressed current was applied to the anodes at a current density sufficient to cause the underground metallic structure to become cathodic. However, these anodes slowly deteriorated so that it was necessary to replace them every few years. An example of this type of structure is Tatum U.S. Pat. No. 3,725,669.

In a further effort to extend the life of the anodes, titanium and niobium anodes have been provided which were partially or completely plated with a noble metal such as platinum, gold, silver, or the like. In the partially plated type of structure, when an impressed current was applied to the anodes, the non-coated portions of the titanium or niobium did not discharge current because the substrate materials had a natural threshold voltage which caused the anode material to polarize and form a non-conducting film along the exposed exterior surfaces, while the current discharge occurred from the plated surfaces into the carbonaceous backfill material. This type of anode has been expensive but has had a longer life.

Some examples of this type of structure are the U.S. Patents to Baum U.S. Pat. No. 1,477,499; Anderson U.S. Pat. No. 2,998,359; Krause U.S. Pat. No. 3,929,607; British Pat. No. 866,577, and the following publications: Platinum Metals Review, Vol. 2, No. 2, April 1958, pages 45–47; Platinum Metals Review, Vol 4, No. 1, January 1960, pages 15–17; Corrosion Technology, February 1960, page 50; Corrosion Technology, January 1962, pages 14–16; Corrosion Technology, February 1962, pages 38–40; Corrosion Prevention and Control, October 1962, pages 51, 52 and 54.

Generally, these prior art anodes and particularly the anodes used in groundbeds, have been long slender anodes having a length of from 9 inches (23 cm) to 8 feet (244 cm) and a diameter of 1 inch (2.54 cm) to 6 inches (15.24 cm) which included a length-to-diameter ratio in excess of one.

Many of these prior anodes have failed prematurely due to a phenomena known as end effect or pencilling. The obvious problem caused by end effect is the consumption of the anode material, ordinarily at one or both ends, resulting in a shorter system life. A less obvious problem is the loss of the electrical connection to the anode while the majority of the anode remains intact. This is due to the fact that most of the anodes available have the electrical connection at one end of the anode. Loss of the connection to one anode in a system results in the inability to discharge any current from the affected anode. Assuming a constant current demand, this means that the remaining anodes of the system must contend with a higher current density which compounds the end effect phenomena resulting in a domino effect.

An early attempt to deal with end effect in deep anode systems involved stacking the anodes close together. This technique involved the mutual interference of current discharged from contiguous anodes and slowed the rate of attack on most of the anodes in the groundbed; however, end effect on the outer anodes tended to be magnified. When the outermost anodes deteriorated, the rate of attack on the next outermost anodes was more severe so that a domino effect again took place.

A later attempt involved the addition of extra anode material round the connection at the end of the anode. This technique only delayed the inevitable result.

A more recent attempt to negate the results of end effect involved locating the electrical connection in the center of the anode. This technique did not solve the problem of end effect but it extended the life of the anode since the connection area was the last area of the anode to be consumed due to end effect.

Our earlier U.S. Pat. No. 4,175,021 was directed to structure for substantially preventing the end effect phenomena and included the optimum segmenting arrangement of an anode for uniform current discharge without particular attention to other engineering considerations. As pointed out in the prior patent, the closer the anode segmenting arrangement approaches a length-to-thickness ratio of one, the more uniform the current density becomes and it has been found that a completely uniform discharge occurs if the anode is generally spherical in shape. However, other engineering considerations must be weighed including resistance-to-earth of the anode as well as the cost in order to produce an anode which is acceptable to the industry.

SUMMARY OF THE INVENTION

The present invention is embodied in an apparatus for reducing or eliminating end effect in the anodes of a cathodic protection system having a carbonaceous backfill surrounding and in intimate engagement with the anodes by causing a substantially uniform current density to be discharged from the surface of the anode into the carbonaceous backfill. The anodes include a plurality of non-conducting bands or dividers which are applied at predetermined non-uniform positions along the length of the anode to decrease the resistance-to-earth of the anode as well as to take advantage of the mutual interference phenomena which permits a greater length-to-thickness ratio without causing end effect.

It is an object of the invention to provide an anode to which an impressed current is applied for use in a cathodic protection system for underground structures and the surface of such anode is separated into a plurality of conducting segments of non-uniform length by a plurality of non-conducting bands so that the calculated current density is discharged along the length of the anode without approaching the threshold for electrolytic discharge.

BRIEF DESCRIPTION OF THE DRAWING

FIG. 1 is diagrammatic sectional view of a cathodic protection system illustrating one embodiment of the invention in use.

FIG. 2 is a perspective view of an anode in accordance with another embodiment of the present invention.

FIG. 3 is a diagrammatic view illustrating the result of a current discharge test on the anode of FIG. 2.

FIG. 4 is a diagrammatic view illustrating the result of a current discharge test on a bare anode.

DESCRIPTION OF THE PREFERRED EMBODIMENTS

The end effect phenomena on anodes in a cathodic protection system has been recognized and has been described as an increased discharge current density occurring at the ends of an impressed current anode which results in a proportional increase in the consumption rate of the anode material at such ends causing a pencilling effect. It has been determined that if an anode is placed in a groundbed of carbonaceous material and the current discharged from the surface of the anode is maintained below approximately 1500 milliamps per square foot, the current transferred from the anode surface will be an electronic discharge and substantially no deterioration of the anode occurs. However, when a long slender anode is placed in the carbonaceous material and the entire surface is calculated to maintain the current density below 1500 milliamps per square foot, the current density at the ends of the anode frequently exceeds the threshold for electrolytic discharge and the anode deteriorates at the ends.

It has been discovered that end effect is a function of the geometry of the anode and that separating the anodes into a plurality of conducting and non-conducting segments which approach a length-to-diameter of one will cause a more uniform current density to be discharged from the anode. This is disclosed in our earlier U.S. Pat. No. 4,175,021 and was based on theory and laboratory experiments. However, engineering considerations must be weighed in order to produce an anode which is acceptable to the industry. During the experiments which resulted in the prior patent, certain features were noted but the full impact of these features was not considered. These features include the phenomena of mutual interference between contiguous segments in the central portion of the anode, the resistance-to-earth of the anode and the cost of producing the same.

With continued reference to the drawing, a groundbed for a cathodic protection system of underground metallic structures is provided which includes a bore hole 10. Such bore hole may be of any desired depth from a deep groundbed which extends to a depth of 250 feet (76.2 meters) to 300 feet (91.4 meters) to a shallow groundbed with the bottom being located at a depth of approximately 15 feet (4.57 meters) below the ground level. At least one anode 11 is positioned at a desired depth within the bore hole 10 and such anode is attached to one end of a lead wire 12. The opposite end of the lead wire is connected to an adjustable rectifier 13, which receives electrical energy from an AC source and converts such energy to a calculated DC impressed current which is supplied to the anode. The rectifier is adjusted in accordance with many variables to cause a current discharge density from the anode of less than 1500 milliamps per square foot. These variables include the depth of the anode, the type and conditions of the ground, the material from which the anode is constructed and the like. When the anode is in position, a carbonaceous material 14 such as calcined petroleum coke, metallurgical coke, graphite or the like is introduced into the bore hole in intimate engagement with the anode and entirely fills the cavity so as to engage the earth which forms the walls of the bore hole.

The anode 11 includes a body 15 and the outer surface of such body is divided into a plurality of conducting segments 16 of non-uniform length by a plurality of non-conducting segments 17. The body 15 may be constructed of iron, steel, graphite, magnetite, copper, titanium, niobium (columbium) or other electricity conducting material. When the body is made of titanium, niobium and the like, such material rapidly polarizes to form an oxide or non-conducting film on the exposed surface when an impressed current is applied. In this case, the body is provided with a plurality of conducting segments of platinum, gold, silver or other noble metal which does not form an oxide film when subjected to electrical energy. Such conducting segments may be applied to the body in any desired manner such as electrodeposition, cladding, plating or the like. The exposed portions of the body between the conducting segments thereby become non-conducting segments as illustrated in FIG. 1. When the anode is constructed of iron, steel, graphite, magnetite, copper or the like, the body is provided with a plurality of bands of dielectric tape, paint or other non-conducting material and the exposed portions of the body constitute the conducting segments as shown in FIG. 2.

The body 10 may be generally square, as shown in FIG. 2, cylindrical or other shape in cross-section and may be of any desired length and thickness. Normally, anodes used in a cathodic protection system are from 9 inches (23 cm) to 8 feet (244 cm) in length and have a thickness of 1 inch (2.54 cm) to 6 inches (15.24 cm). As a specific example, the body shown in FIG. 2 is generally square in cross-section and has a thickness of approximately 3 inches (7.62 cm). Such body includes outer conducting segments 18, which include the end surfaces of the body, intermediate conducting segments 19 and an inner conducting segment 20 and such conducting segments are separated from each other by the non-conducting segments 17. The outer conducting segments 18 preferably have a length of approximately 7 inches (17.78 cm), the intermediate segments 19 have a length of approximately 9 inches (22.86 cm) and the inner segment has a length of approximately 16 inches (40.64 cm). As illustrated, the non-conducting segments 17 have a uniform length of approximately 6 inches (15.24 cm); however, it is contemplated that such non-conducting segments may have either uniform or non-uniform lengths of any desired size.

In this construction the length-to-thickness ratio of the outer conducting segment 18 is approximately 2 to b 1, the ratio of the intermediate conducting segment 19 is approximately 3 to 1, and the ratio of the inner conducting segment is in excess of 5 to 1.

This segmenting technique is the result of engineering compromises in the area of uniform current density, manufacturing costs, and resistance-to-earth of the anode. It has been determined that the discharge density from the ends of two impressed current anodes in close axial proximity to one another, will not amount to twice the discharge density from the ends of each anode individually. This fact has been attributed to the mutual interference between the anodes. Also, it has been found that the closer the anodes are moved toward each other, the greater the mutual interference between the anodes.

The configuration of the anode 11 including the elongated inner and intermediate conducting segments is possible without approaching the threshold of electrolytic current discharge thereby causing deterioration of the end portion of the inner and intermediate conducting segments due to mutual interference of the current discharged from such segments. The outer conducting segments have mutual interference with a contiguous conducting segment at one end only; however, such outer segments have a length-to-thickness ratio of approximately 2 to 1 so that the current density being discharged from such outer segments remains as an electronic discharge and a substantially uniform current which may be accurately calculated is discharged along the entire length of the anode to reduce or eliminate end effect on all of the segments.

This technique was tested in a laboratory by comparing a bare control anode with an anode as described above. In order to make this test, a conductive electrolyte was formulated by combining a neutral gel, tap water, and sodium chloride. The mixture was then placed in two open-top steel containers which served as the cathode and equal amounts of mythol orange, a pH indicator, was added to the gel solutions. Mythol orange has a pH range of from 3.1 to 4.4 and exhibits a pink color in the acid range and a yellow color in the base range. The purpose of using a gel as the electrolyte rather than a liquid was to decrease the mobility of the ions within the solution. Due to the electrolytic action around the anodes, a more acid condition is created when a current is discharged from the anode, and the greater the current discharge, the more acid that will be formed. When a pH indicator surrounds the anode, the color changes around the anode indicate the relative current density along the anode surface. A current of approximately ½ amp was impressed between the segmented anode and the first steel container as well as between the bare control anode and the second steel container. The results of these tests are illustrated in FIGS. 3 and 4, respectively.

With particular reference to FIG. 3, a segmented anode 11 in accordance with the present invention was used in the test and this anode caused a color change the extent of which is represented by the dotted lines 21. It is clear that the current discharge is substantially uniform along the length of the anode as indicated by the numeral 22. Also, the current discharge from opposite ends of the anode is substantially the same and is represented by the numeral 23. It is noted that the values represented by the numerals 22 and 23 are similar to each other.

With particular reference to FIG. 4, the bare control anode 24 which was used in the test caused a color change, the extent of which is represented by the dash line 25. It is clear that the current discharge in the central portion of the anode, which is indicated by the numeral 26, is substantially less than the current discharge at opposite ends which is indicated by the numeral 27. In fact, the color at the ends of the anode appeared to extend outwardly a distance substantially 2½ times the distance indicated by the numeral 26.

In our prior U.S. Pat. No. 4,175,021, we made reference to the resistance-to-earth of the anodes covered by that patent. This was based on half of the anode having conducting surfaces and half having non-conductive surfaces. The most advantageous condition of the prior anode indicated an increase in resistance-to-earth of 24% over a bare anode. In order to decrease the resistance-to-earth of the anode, the non-conducting surfaces of the anode of this invention have been reduced so that such surfaces cover approximately ⅓ of the length of the anode while the conducting surfaces are spread over approximately ⅔ of such length. With this geometry, the resistance-to-earth of the anode 11 is increased only slightly over a bare anode.

It is important that the carbonaceous material 14 be in intimate engagement with the earth as well as the anode 11 and provide good contact with the surfaces of the conducting segments 16. When this is done, the current density from the anode surface is maintained at a level that can be electronically conducted by the carbonaceous material to the earth. Under these conditions, most of the consumption occurs only at the outer periphery of the carbonaceous material with little or no consumption of the anode itself, thus resulting in a significant increase in the overall life of the system.

We claim:

1. Apparatus for reducing the end effect phenomena in anodes used in an impressed current cathodic protection system for underground metallic structures comprising an anode located within a cavity in the earth, said anode having an elongated body of electrical current conduction material, said body having a predetermined thickness, a pair of first nonconducting segments disposed on and around said body and spaced inwardly from opposite ends thereof and forming portions of the exterior surface of said body, the end surfaces of said body and the side surfaces of said body from the end surfaces to said first nonconducting segments defining first conducting segments of a first length, said first conducting segments having a length to thickness ratio of approximately two to one with respect to the thickness of said body, at least one pair of second nonconducting segments spaced inwardly along said body from said first nonconducting segments, the surfaces of said body between said first and second nonconducting segments defining second conducting segments of a second length which is greater than said first length, the surfaces of said body between said second nonconducting segments defining at least a third conducting segment of a third length which is greater than said second length, a carbonaceous material surrounding and in intimate engagement with the entire length of each of said conducting segments and communicating with the walls of the cavity in the earth, a lead wire electrically connected to said anode, and means for supplying an impressed current to said lead wire and said anode, whereby the length to thickness ratio of said first conducting segments causes the impressed current to be discharged therefrom as an electronic current and mutual interference between the first, second and third conducting segments causes the impressed current to be discharged as an electronic current from the remainder of the anode so that a substantially uniform electronic current density is discharged along the entire length of the anode into said carbonaceous material.

2. The structure of claim 1 in which each of said nonconducting segments are of substantially equal length which is less than said first length of said conducting segments.

3. The structure of claim 1 in which each of said conducting segments includes a layer of noble metal which is applied to said body.

4. The structure of claim 1 in which said second conducting segments have lengths which are at least approximately three times the thickness of said body and said third conducting segment is at least approximately five times the thickness of said body.

5. The structure of claim 1 in which said nonconducting surfaces are integrally formed with said body.

6. An anode for use in an underground impressed current cathodic protection system, said anode being located in a cavity in the earth and comprising a substantially solid elongated body of a predetermined thickness and being constructed of electrical current conducting material, said body having first and second ends and an outer surface, means to connect an electrical lead wire to said body, a plurality of spaced nonconductive material segments disposed completely around and in continuous intimate engagement with said outer surface of said body, a first and second of said nonconductive material segments being spaced inwardly from said first and second ends of said body respectively thereby defining a pair of outermost conductive surface segments of a first length, at least one other of said nonconductive material segments being spaced between said first and second nonconductive material segments so as to define at least one first inner conductive surface segment therebetween of a second length being greater than said first length of said outermost conductive surface segments whereby the geometry of the current conducting surface segments of the anode substantially reduce the end effect phenomena when an electrical current is supplied to said body.

7. The structure of claim 6 in which each of said nonconductive material segments are of substantially equal length which is less than said first length of said outermost conductive surface segments.

8. The structure of claim 6 in which each of said conductive surface segments includes a layer of noble metal which is applied to said outer surface of said body.

9. The structure of claim 6 in which each of said nonconductive material segments includes a coating of nonconducting material which is applied to said outer surface of said body.

10. The structure of claim 6 in which said first length of said outermost conductive surface segments are at least approximately twice the thickness of said body.

11. The structure of claim 10 in which said second lengths of said first inner conductive surface segments is at least approximately three times the thickness of said body.

12. The structure of claim 6 including additional inner conductive surface segments which are more centrally oriented between said first and second ends of said body than are said first inner conductive surface segments, said additional inner conductive surface segments being of a length greater than the length of said second length of said first inner conductive surface segments.

13. The structure of claim 6 in which said nonconductive material segments cover approximately one-third of the outer surface of said body.

14. The structure of claim 6 in which each of said conductive material segments includes a layer of a noble metal which is applied to said body.

15. An anode for use in underground impressed current cathodic protection system in which the anode is located in a cavity in the earth comprising an elongated body of a predetermined thickness and being constructed of electrical current conducting material, said body having end and intermediate portions, means to connect a source of electrical current to said body, first conductive material segments carried by said end portions of said body and extending completely around said end portions of said body and extending inwardly toward said intermediate portion thereof and being in continuous intimate contact therewith, said first conductive material segments being of a first length, at least one second conductive material segment disposed completely around a portion of the length of said intermediate portion of said body and in continuous intimate engagement therewith, said second conductive material segment being spaced from and between said first conductive material segments and being of a second length, said second length of said second conductive material segments being greater than said first length of said first conductive material segments, the surface portions of said body between said first and second conductive material segments being oxidized to thereby be nonconducting, whereby said anode will be defined by alternating conducting and nonconducting surface portions.

16. An anode for use in an underground impressed current cathodic protection system in which the anode is located in a cavity in the earth comprising, a substantially solid elongated body having a predetermined thickness and first and second ends and an outer surface, said body being constructed of electrical current conducting material, a plurality of nonconducting segments disposed on and completely around said body, each of said nonconducting segments being in intimate and continuous engagement with said outer surface of said body and being spaced inwardly from said ends thereof and in spaced noncontacting relationship with each other, said nonconducting segments being disposed generally normal to the axis of said body, said nonconducting segments dividing said body into a plurality of separate and spaced conducting surface segments of at least three different lengths, the endmost conducting segments having a first length, the remaining conducting segments having lengths which are greater than said first length of said endmost segments and being of progressively greater length as such remaining conducting segments become more centrally oriented between said ends of said body, whereby the geometry of the anode substantially reduces the end effect phenomena when an impressed electrical current is applied to said body.

17. The structure of claim 16 in which said nonconducting segments cover approximately one-third of the outer surface of said body.

18. The invention of claim 16 in which said first length of said endmost conducting segments is substantially equal to twice the thickness of said anode.

* * * * *